US005664299A

United States Patent [19]

Porchia et al.

[11] Patent Number: 5,664,299

[45] Date of Patent: Sep. 9, 1997

[54] RECLOSABLE FASTENER ASSEMBLY

[75] Inventors: Jose Porchia, Midland; Brian C. Dais, Sanford, both of Mich.

[73] Assignee: Dowbrands L.P., Indianapolis, Ind.

[21] Appl. No.: 711,643

[22] Filed: Sep. 10, 1996

[51] Int. Cl.[6] ..... A44B 19/00

[52] U.S. Cl. ..... 24/400; 24/399; 24/587

[58] Field of Search ..... 24/400, 399, 587, 24/576; 383/63

[56] References Cited

U.S. PATENT DOCUMENTS

| | | | |
|---|---|---|---|
| 3,122,807 | 3/1964 | Ausnit . | |
| 3,173,184 | 3/1965 | Ausnit . | |
| 3,426,396 | 2/1969 | LaGjerre . | |
| 4,262,395 | 4/1981 | Kosky . | |
| 5,007,143 | 4/1991 | Herrington . | |
| 5,020,194 | 6/1991 | Herrington et al. . | |
| 5,063,644 | 11/1991 | Herrington et al. | 24/400 |
| 5,070,583 | 12/1991 | Herrington | 24/400 |
| 5,301,395 | 4/1994 | Richardson et al. . | |
| 5,442,837 | 8/1995 | Morgan . | |
| 5,442,838 | 8/1995 | Richardson et al. . | |

FOREIGN PATENT DOCUMENTS

| | | | |
|---|---|---|---|
| 1564039 | 4/1969 | France | 24/400 |

*Primary Examiner*—Victor N. Sakran

[57] ABSTRACT

A reclosable fastener assembly having two interlocking profiles with uppermost closure elements and bottommost closure elements and a slider for moving between a closed position and an open position along the profiles in straddling relation. The slider has a top and side walls depending from opposite sides of the top for receiving the profiles therebetween. The side walls extend downward from the top to a point at or below the profiles, and the side walls extend from a separating end of the slider to a pinching end. The side walls have a greater spacing at the separating end than at the pinching end, but close enough at the pinching end to press the first and second profiles into an interlocked relationship as the slider is moved toward the closed position. The slider has a separating leg depending from the top between the first and second side walls at the separating end of the slider. The separating leg is inserted between at least the uppermost closure elements of the first and second profiles, but not between the bottommost closure elements. In a second aspect, the fastener assembly includes means for holding the bottommost closure elements in interlocked relationship when the slider is in the closed position, such that the bottommost closure elements are in interlocked relationship throughout their entire length.

22 Claims, 3 Drawing Sheets

RECLOSABLE FASTENER ASSEMBLY

BACKGROUND OF THE INVENTION

Reclosable fastener assemblies are useful for sealing thermoplastic bags. Such fastener assemblies often include a plastic zipper and a slider. Typically, the plastic zippers include a pair of interlockable fastener elements, or profiles, that form a closure. As the slider moves across the profiles, the profiles are opened or closed.

The profiles in plastic zippers can take on various configurations. For example, U.S. Pat. No. 5,140,727 describes interlocking rib and groove elements, whereas U.S. Pat. No. 5,007,143 describes a rolling action zipper profile, and U.S. Pat. No. 4,747,702 describes profiles that are U-shaped with interlocking hooks.

The sliders for opening or closing the reclosable fasteners are generally shaped so that the slider straddles the profiles. The sliders often include a separating element that is inserted through the profiles in order to open the fastener. Such a slider is described in U.S. Pat. No. 5,067,208. In other types of sliders, the separating element does not penetrate the profiles, but rather, slides above the profiles on a specially adapted track located above the profiles, as described in U.S. Pat. No. 5,007,143. The separating elements have various shapes. For example, U.S. Pat. No. 3,173,184 describes a V-shaped separating element, while U.S. Pat. No. 5,067,208 describes a tapered separating element with a circular end.

A disadvantage of the known fastener assemblies is that thermoplastic bags incorporating the fastener assemblies often leak. Another disadvantage of the known fastener assemblies is that the zippers can be rigid and not very flexible, while the sliders can be large, cumbersome and expensive to manufacture. It would be an advance in the art of reclosable fastener assemblies to have a simplified slider, while minimizing leakage of liquids through the closure.

SUMMARY OF THE INVENTION

The present invention solves the above problems to a large degree. In one aspect, the present invention is a reclosable fastener assembly comprising five elements. The first element is a first fastener strip having an inner surface and an outer surface. The second element is a second fastener strip having an inner surface and an outer surface. The third element is a first profile positioned along the length of the inner surface of the first fastener strip, the first profile having a plurality of closure elements, the plurality of closure elements including at least an uppermost element and a bottommost element. The fourth element is a second profile positioned along the length of the inner surface of the second fastener strip, the second profile having a plurality of closure elements, the elements including at least an uppermost element and a bottommost element, the elements of the second profile being adapted to engage with the elements of the first profile, thereby interlocking the second profile with the first profile. The fifth element is a slider for moving between a closed position and an open position along the fastening strips in straddling relation, the slider having a top and side walls depending from opposite sides of the top for receiving the fastening strips therebetween, the side walls extending downward from the top so that at least a portion of the profiles is held between the side walls, the side walls extending from a separating end of the slider to a pinching end, the side walls having a greater spacing at the separating end than at the pinching end, the side walls being spaced close enough at the pinching end to press the first and second profiles into an interlocked relationship as the slider is moved toward the closed position, the slider having a separating leg depending from the top between the first and second side walls at the separating end of the slider, the separating leg being inserted between at least the uppermost closure elements of the first and second profiles, but not between the bottommost closure elements.

In a second aspect, the present invention is a reclosable fastener assembly comprising six elements. The first element is a first fastener strip having an inner surface and an outer surface. The second element is a second fastener strip having an inner surface and an outer surface. The third element is a first profile positioned along the length of the inner surface of the first fastener strip, the first profile having a plurality of closure elements, the plurality of closure elements including at least an uppermost closure element and a bottommost closure element. The fourth element is a second profile positioned along the length of the inner surface of the second fastener strip, the second profile having a plurality of closure elements, the elements including at least an uppermost closure element and a bottommost closure element, the closure elements of the second profile being adapted to engage with the elements of the first profile, thereby interlocking the second profile with the first profile. The fifth element is a slider for moving between a closed position and an open position along the fastening strips in straddling relation, the slider having a top and side walls depending from opposite sides of the top for receiving the fastening strips therebetween, the side walls extending from a separating end of the slider to a pinching end, the side walls having a greater spacing at the separating end than at the pinching end, the side walls being spaced close enough at the pinching end to press the first and second profiles into an interlocked relationship as the slider is moved toward the closed position, the slider having a separating leg depending from the top between the first and second side walls at the separating end of the slider, the separating leg being inserted between at least the uppermost closure elements of the first and second profiles, but not between the bottommost closure elements. The sixth element is means for holding the bottommost closure elements in interlocked relationship when the slider is in the closed position, such that the bottommost closure elements are in interlocked relationship throughout their entire length.

DESCRIPTION OF THE PREFERRED EMBODIMENTS

Figure 1:
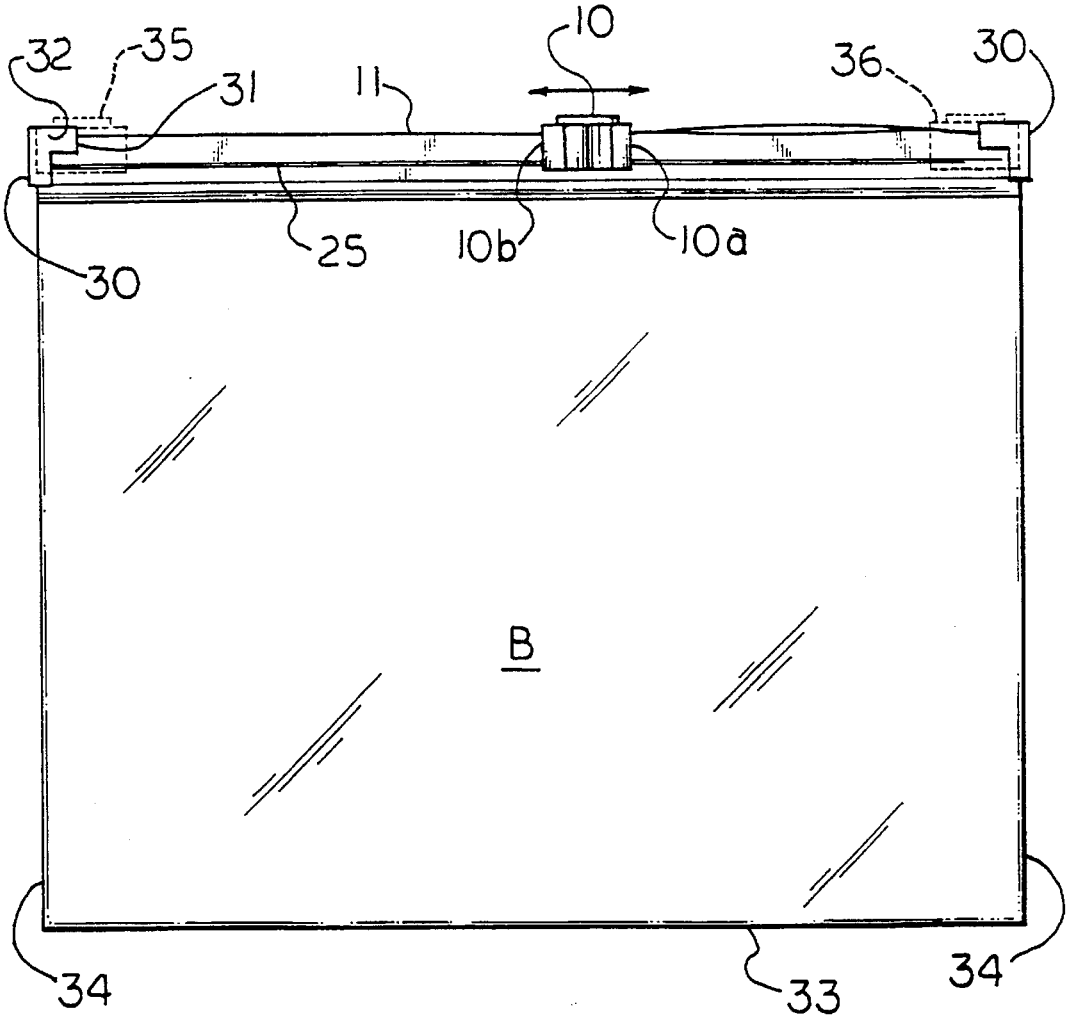
FIG. 1 is a plan view of a thermoplastic bag having a zipper an a slider.

Referring now to FIG. 1, therein is shown a reclosable thermoplastic bag B having a profiled plastic reclosable fastener 11 and a slider 10, embodying the present invention. Bag B also has a sealed bottom 33 and two opposing sealed edges 34. Bag B may be made from any suitable thermoplastic film such as, for example, low density polyethylene, linear low density polyethylene, substantially linear copolymers of ethylene and a C3–C8 α-olefin, polypropylene, polyvinylidene chloride, mixtures of two or more of these polymers, or mixtures of one of these polymers with another thermoplastic polymer.

Figure 2:
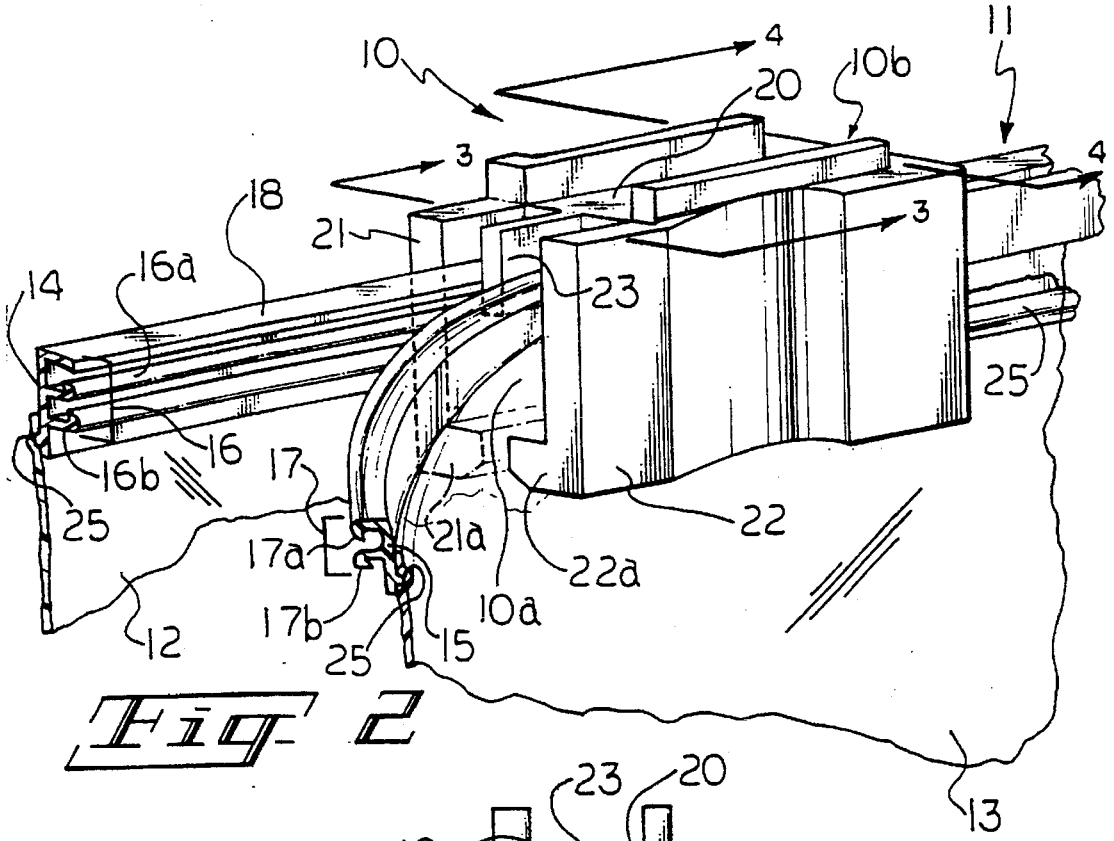
FIG. 2 is a perspective view of a reclosable thermoplastic bag with zipper and slider.
Figure 3:
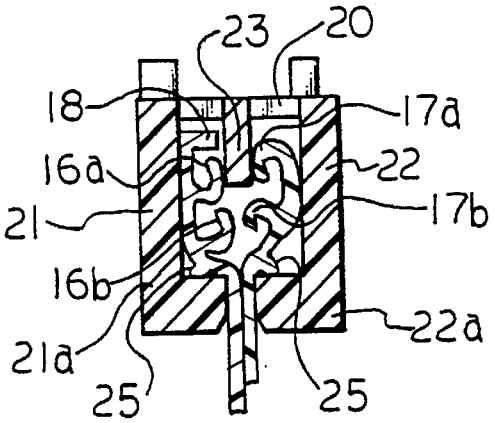
FIG. 3 is a cross sectional view of an open profile and slider of the instant invention taken along line 3—3 of FIG. 2.

Referring now to FIG. 2, the bag B comprises a pair of flexible plastic sheets 12 and 13. The sheet 12 has a top edge having a first fastener strip 14 attached thereto. The first fastener strip 14 has an inner surface on the inside of the bag and an outer surface on the outside of the bag. The sheet 13 has a top edge having a second fastener strip 15 attached thereto. The second fastener strip 15 has an inner surface on the inside of the bag and an outer surface on the outside of the bag. The strips 14 and 15 may be extruded separately and attached to the respective sides of the bag mouth or the strips 14 and 15 may be extruded integrally with the sides of the bag mouth.

A first profile 16 extends along the inner surface of the first fastener strip 14. A second profile 17 extends along the inner surface of the second fastener strip 14.

As shown in FIGS. 2–5, the first profile 16 has at least an uppermost closure element **16*a* and a bottommost closure element 16*b*. The closure elements 16*a* and 16*b* project laterally from the inner surface of strip 14. Likewise, the second profile 17 has at least an uppermost closure element 17*a* and a bottommost closure element 17*b*. The closure elements 17*a* and 17*b* project laterally from the inner surface of strip 15. When the bag is closed, the closure elements of profile 16 interlock with the corresponding closure elements of profile 17. As shown in FIGS. 2–5, closure elements 16*a*, 16*b*, 17*a* and 17*b* have hooks on the ends of the closure elements, so that the profiles remain interlocked when the bag is closed, thereby forming a seal. The seal advantageously is such that under normal conditions of use, it forms a barrier to liquids. Profiles 16 and 17** can each have more than two closure elements, so that any number of closure elements can be disposed between the uppermost and bottommost closure elements. The closure elements can be any shape, such as a rib and groove shape as described in U.S. Pat. No. 5,140,727, or an angled hook shape, as described in U.S. Pat. No. 4,747,702.

Figure 4:
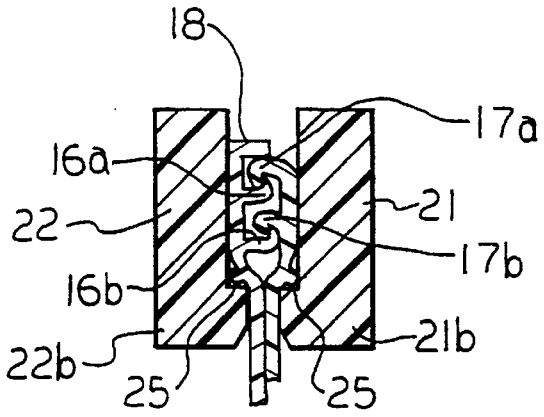
FIG. 4 is a cross sectional view of a closed profile and slider of the instant invention taken along line 4—4 of FIG. 2.

When the bag B is open, fastener strips 14 and 15 are separated from each other as are the profiles 16 and 17 on the respective strips. As shown in FIG. 4, closure elements **16*a*, 17*a*, 16*b*, and 17*b* have a complimentary cross-sectional shape such that they are closed by pressing the profiles together. The pressing action is accomplished by a pinching end 10*b* of the slider 10 which straddles the fastener strips 14 and 15 and is adapted to close or open the closure elements 16 and 17** of the reclosable fastener.

Referring again to FIG. 1, the slider 10 moves between a closed position 35 and an open position 36. Thus, when the slider 10 reaches the closed position 35 at one end of the fastening strips, the bag is closed, and the profiles are interlocked throughout substantially their entire length. When the slider reaches the open position 36 at the opposite end of the fastening strips, the bag is open and the profiles are disengaged throughout most of their length. It should be understood that it is sufficient for at least the bottommost closure elements to be interlocked with each other throughout substantially their entire length, in order for the bag to be closed. Preferably, the uppermost closure elements are also interlocked with each other, although they need not be.

Referring now to FIG. 2, the straddling slider 10 comprises an inverted U-shaped member having a top 20 for moving along the top edges of the strips 14 and 15. The slider 10 has side walls 21 and 22 depending from the top 20. Side walls 21 and 22 extend downward along the outer surface of the fastener strips 14 and 15, to a point at or below the profiles 16 and 17, so that at least a portion of the profiles 16 and 17 are held between the side walls 21 and 22. Side walls 21 and 22 cooperate with the strips 14 and 15 so that, as the slider moves between the open and closed position, strips 14 and 15 are received between the side walls 21 and 22.

Figure 6:
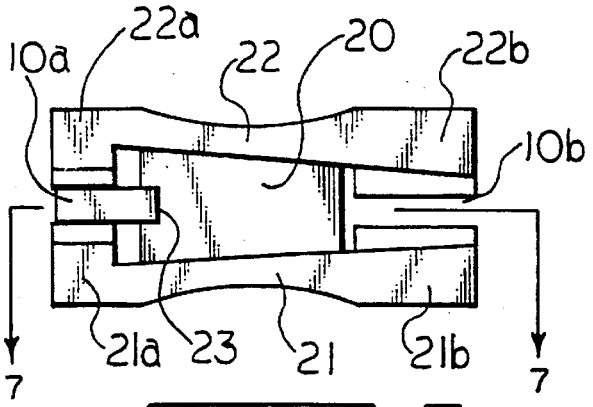
FIG. 6 is a bottom plan view of the slider in FIG. 2.
Figure 7:
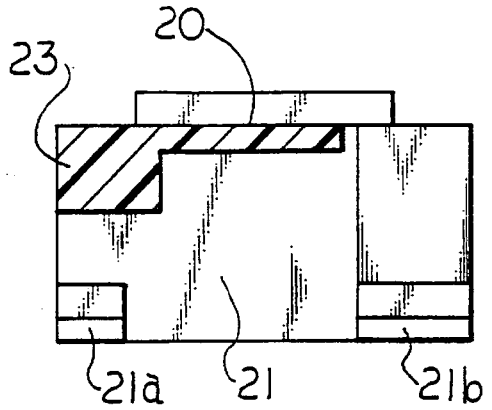
FIG. 7 is a cross sectional view of a slider taken along line 7—7 of FIG. 6.

As shown in FIG. 6, side walls 21 and 22 extend from a separating end **10*a* of the slider to a pinching end 10*b* of the slider. The side walls 21 and 22 are spaced farther apart at the separating end 10*a* than at the pinching end 10*b*. The closer spacing at the pinching end 10*b* acts to pinch, or squeeze the fastening strips together, thereby forcing the profiles 16 and 17 into an interlocked relationship. As shown in FIG. 4, the profiles can be squeezed together all at once, i.e., the uppermost closure elements 16*a* and 17*a* are pressed together at approximately the same time that the bottommost closure elements 16*b* and 17*b*** are pressed together. Alternatively, the profiles can be interlocked by a rolling action, as described in U.S. Pat. No. 5,007,143.

As shown in FIGS. 2–7, a separating leg 23 depends from the top 20 between the side walls 21 and 22 and is inserted between the uppermost closure elements **16*a* and 17*a* of profiles 16 and 17. As shown, the separating leg is positioned at the separating end 10*a* of the slider 10, although the separating leg can be positioned anywhere along the top. Preferably, the separating leg 23** has a width, i.e., a dimension from side to side, of from about 1/32 to about 1/8 inches. Preferably, the separating leg has a length, i.e., a dimension from the separating end to the pinching end, of from about 1/16 to about 1/4 inches.

The separating leg 23 does not extend all the way through the profiles 16 and 17. Rather, the separating leg 23 extends through the uppermost closure elements **16*a* and 17*a* but does not extend far enough to reach between the bottommost closure elements 16*b* and 17*b***. If the profile has intermediate closure elements between the uppermost and bottommost closure elements, the separating leg can extend between the intermediate closure elements, although the separating leg need not do so.

When the slider 10 is moved toward the open position 36, the pinching end **10*b* of the slider leads, and the separating end 10*a* of the slider trails, so that the separating leg 23 disengages the profiles 16 and 17. When the slider 10 is moved toward the closed position 35, the separating end 10*a* leads and the pinching end 10*b* trails, so that the pinching end 10*b* squeezes the profiles together into engagement. The spacing between the bottommost closure elements 16*b* and 17*b* and the uppermost closure elements 16*a* and 17*a*, should be sufficient so that the bottommost profiles are pulled open as the separating leg 23 forces the uppermost closure elements apart when the slider moves toward the open position 36**.

The fastening assembly optionally includes means for maintaining the slider in straddling relation with the fastening strips. In the embodiment shown in FIGS. 2–7, the means includes ridges 25 on the outer surfaces of the fastening strips 14 and 15, and shoulders **21*a*, 22*a*, 21*b* and 22*b* on the side walls of the slider. Shoulders 21*a* and 22*a* project inwardly from the depending side walls at the separating end 10*a* of the slider. As shown, the slider also has shoulders 21***b* and 22*b* projecting inwardly from the depending side walls at the pinching end 10*b* of the slider. The shoulders 21*a*, 22*a*, 21*b* and 22*b* project inwardly at a point at or below the profiles 16 and 17. The shoulders act as means for maintaining the slider in straddling relation with the fastening strips by grasping the lower surfaces of the ridges 25. The ridges 25 thus act as handles for the slider to hold onto, such that the slider 10 maintains the straddling relation with the fastening strips and does not fall off the bag. The shoulders can be continuous along the entire length of the slider, if desired, in order to maximize the security to the bag. Ridges 25 extend along the length of the outer surface of fastener strips 14 and 15 at a point at or below the profiles, and can be attached to the fastener strips by any desired means, such as, for example, by extruding with the fastener strips, heating, gluing, or snapping in place. The ridges can also result from the difference in thicknesses between the profiles and the bag.

Figure 5:
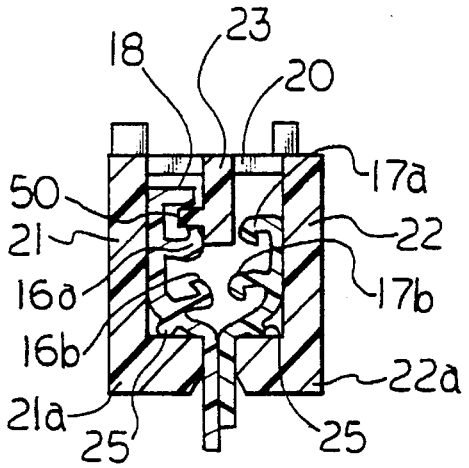
FIG. 5 is a cross sectional view of an alternate embodiment of an open profile and slider.

Alternatively, means for maintaining the slider in straddling relation with the fastening strips can include an extension 50 on the separating leg 23 in conjunction with a flange 18 positioned above the profile 16 along the length of fastener strip 14, as shown in FIG. 5. As the slider moves along the fastener strips, the extension 50 slides between the uppermost closure element 16*a* and the flange 18. When the fastening assembly is closed, flange 18 covers the uppermost closure elements 16*a* and 17*a*. Flange 18 is optional. There may be a flange on both fastening strips, if desired.

The slider 10 may be made in multiple parts and welded together or the parts may be constructed to be snapped together. The slider 10 may also be of one piece construction. The slider can be made using any desired method, such as, for example, injection molding or any other method. The slider can be molded from any suitable plastic such, for example, as nylon, polypropylene, polystyrene, acetal, toughened acetal, polyketone, polybutylene terephthalate, high density polyethylene, polycarbonate, or ABS. The slider can be clear, opaque, or colored.

A bag incorporating the fastener and slider of the present invention optionally includes means for preventing the slider from sliding off the end of the bag once the slider reaches the closed position 35 or open position 36. Preferably, the means for preventing the slider from sliding off the end includes means for holding the bottommost closure elements in interlocked relationship when the slider is in the closed position, including the area beneath the separating leg, such that the bottommost closure elements are in interlocked relationship throughout substantially their entire length. Such means for holding the bottommost closure elements together can include, for example, a fused section of the bottommost closure elements proximate to the closed position 35. The fused section of the profiles proximate to the closed position preferably creates a raised end stop 30. Preferably, a fused section of the profiles is also proximate to the open position 36.

"Proximate to the closed position" is defined herein to mean, when the slider is in the closed position, the space at least between the slider and the ends of the fastener strips. This distance can be narrow, if the closed position is chosen to be towards the very end of the fastener strip, or this distance can be wide, if the closed position is chosen to be farther away from the ends of the fastener strips, such as when large end stops are desired.

When a fused end stop 30 is used in conjunction with a ridge 25, it is preferred that the ridge 25 extends on each end at least to an inward edge 31 of the fused section, and preferably past the inward edge thereof, as shown in FIG. 1, so that the ridge 25 works to cooperate with the fused section 30 to hold the slider 10 onto the bag.

The profiles can be fused by a clamp, an adhesive, pressure, heat, mechanically, ultrasonically, or by any other desired method. The resulting end stops 30 perform the dual function of stops for the ends of the fastener 11 to prevent the slider 10 from going off past the end of the fastener 11 and they also hold the two profiles 16 and 17 together to prevent the bag from opening in response to stresses applied to the profiles through normal use of the bag. The end stops 30 also provide a convenient finger grip for the user when moving the slider 10.

Alternative means for preventing the slider from sliding off the end of the bag include riveted end clamps such as those described in U.S. Pat. Nos. 5,067,208 and 5,161,286, transverse end stops made from molten material for the profiles, as described in U.S. Pat. No. 5,088,971, reciprocating anvils, as described in U.S. Pat. No. 5,131,121, tubular end stops, as described in U.S. Pat. No. 5,405,478, a window structure combined with sealed zipper ends, as described in U.S. Pat. No. 5,442,837, or plastic end clips fused to the zipper as described in U.S. Pat. No. 5,448,807.

The fastening assembly of the present invention optionally includes means for retaining the slider in the closed position so that a bag incorporating the zipper and slider of the present invention does not inadvertently open. For example, the means for retaining the slider in closed position can comprise a notch structure such as that disclosed in U.S. Pat. No. 5,067,208, or a notch structure with diverging ends such as that disclosed in U.S. Pat. No. 5,301,395. In yet another alternative, the means for retaining the slider in closed position can comprise a latching means, such as a detent on the slider together with a protrusion on the zipper as disclosed in U.S. Pat. No. 5,189,764.

The bag of the present invention can be made using methods well known in the art, such as, for example, by blow or cast extrusion. The slider can be attached to the fastener strips using methods such as causing reciprocal movements of the clasp using a tool, as described in U.S. Pat. No. 4,262,395, through a hinge structure which attaches wings to the body of the slider, as described in U.S. Pat. No. 5,067,208, through a rigidizing structure as described in U.S. Pat. No. 5,283,932, or through in-place assembly.

What is claimed is:

1. A reclosable fastener assembly comprising:

a) a first fastener strip having an inner surface and an outer surfaces;

b) a second fastener strip having an inner surface and an outer surface;

c) a first profile positioned along the length of the inner surface of the first fastener strip, the first profile having a plurality of closure elements, the plurality of closure elements including at least an uppermost element and a bottommost element;

d) a second profile positioned along the length of the inner surface of the second fastener strip, the second profile having a plurality of closure elements, the elements including at least an uppermost element and a bottommost element, the elements of the second profile being adapted to engage with the elements of the first profile, thereby interlocking the second profile with the first profile; and e) a slider for moving between a closed position and an open position along the fastening strips in straddling relation, the slider having a top and side walls depending from opposite sides of the top for receiving the fastening strips therebetween, the side walls extending downward from the top to a point at or below the profiles, so that at least a portion of the profiles are held between the side walls, the side walls extending from a separating end of the slider to a pinching end, the side walls having a greater spacing at the separating end than at the pinching end, the side walls being spaced close enough at the pinching end to press the first and second profiles into an interlocked relationship as the slider is moved toward the closed position, the slider having a separating leg depending from the top between the first and second side walls at the separating end of the slider, the separating leg being inserted between at least the uppermost closure elements of the first and second profiles, but not between the bottommost closure elements.

2. The fastener assembly of claim 1 wherein the profiles are fused proximate to the closed position.

3. The fastener assembly of claim 2 wherein the fused profiles create an end stop.

4. The fastener assembly of claim 2 wherein the fused profiles hold the bottommost closure elements together such that when the slider is in the closed position, the bottommost closure elements are in interlocked relationship throughout their entire length.

5. The fastener assembly of claim 2, wherein the fused profiles create an end stop and hold the bottommost closure elements together such that when the slider is in the closed position, the bottommost closure elements are in interlocked relationship throughout their entire length.

6. The fastener assembly of claim 5, further comprising means for maintaining the slider in straddling relation with the fastening strips.

7. The fastener assembly of claim 6, wherein the means for maintaining the slider in straddling relation includes shoulders depending from the side walls of the slider, and ridges projecting from the outside edges of the fastener strips along the lengths thereof at or below the profiles, such that the shoulders grasp the surface of the ridge.

8. The fastener assembly of claim 6, wherein the means for maintaining the slider in straddling relation includes a flange positioned along the length of at least one of the profiles above the uppermost closure element, and an extension protruding from the separating leg of the slider, the extension sliding between the uppermost closure element and the flange as the slider moves.

9. The fastener assembly of claim 6, wherein the profiles are fused by means of a clamp.

10. The fastener assembly of claim 6, wherein the profiles are fused by means of an adhesive.

11. The fastener assembly of claim 6, wherein the profiles are fused by melting means.

12. The fastener assembly of claim 6, wherein the profiles are fused by mechanical means.

13. A reclosable fastener assembly comprising:

a) a first fastener strip having an inner surface and an outer surface;

b) a second fastener strip having an inner surface and an outer surface;

c) a first profile positioned along the length of the inner surface of the first fastener strip, the first profile having a plurality of closure elements, the plurality of closure elements including at least an uppermost closure element and a bottommost closure element;

d) a second profile positioned along the length of the inner surface of the second fastener strip, the second profile having a plurality of closure elements, the elements including at least an uppermost closure element and a bottommost closure element, the closure elements of the second profile being adapted to engage with the elements of the first profile, thereby interlocking the second profile with the first profile;

e) a slider for moving between a closed position and an open position along the fastening strips in straddling relation, the slider having a top and side walls depending from opposite sides of the top for receiving the fastening strips therebetween, the side walls extending from a separating end of the slider to a pinching end, the side walls having a greater spacing at the separating end than at the pinching end, the side walls being spaced close enough at the pinching end to press the first and second profiles into an interlocked relationship as the slider is moved toward the closed position, the slider having a separating leg depending from the top between the first and second side walls at the separating end of the slider, the separating leg being inserted between at least the uppermost closure elements of the first and second profiles, but not between the bottommost closure elements; and f) means for holding the bottommost closure elements in interlocked relationship when the slider is in the closed position, such that the bottommost closure elements are in interlocked relationship throughout their entire length.

14. The fastener assembly of claim 13 wherein the means for holding the bottommost closure elements in interlocked relationship is a fused section of the bottommost closure elements proximate to the closed position.

15. The fastener assembly of claim 14, wherein the fused section creates an end stop.

16. The fastener assembly of claim 15, further comprising means for maintaining the slider in straddling relation with the fastening strips.

17. The fastener assembly of claim 16, wherein the means for maintaining the slider in straddling relation includes shoulders depending from the side walls of the slider, and ridges projecting from the outside edges of the fastener strips along the lengths thereof at or below the profiles, such that the shoulders grasp the surface of the ridge.

18. The fastener assembly of claim 16, wherein the means for maintaining the slider in straddling relation includes a flange positioned along the length of at least one of the profiles above the uppermost closure element, and an extension protruding from the separating leg of the slider, the extension sliding between the uppermost closure element and the flange as the slider moves.

19. The fastener assembly of claim 16, wherein the profiles are fused by means of a clamp.

20. The fastener assembly of claim 16, wherein the profiles are fused by means of an adhesive.

21. The fastener assembly of claim 16, wherein the profiles are fused by melting means.

22. The fastener assembly of claim 16, wherein the profiles are fused by mechanical means.

* * * * *